US005524415A

United States Patent [19]

Pachinger et al.

[11] Patent Number: 5,524,415

[45] Date of Patent: Jun. 11, 1996

[54] CARRIAGE FOR A WRAP APPARATUS

[75] Inventors: William J. Pachinger, Westlake; John H. Rummell, Olmsted Township; Stanley J. Ryba, North Olmsted, all of Ohio

[73] Assignee: Olympus Optical Co., Ltd., Tokyo, Japan

[21] Appl. No.: 282,884

[22] Filed: Jul. 29, 1994

[51] Int. Cl.[6] ..... B65B 41/12; B65H 19/30

[52] U.S. Cl. ..... 53/203; 242/557; 414/444; 414/911; 53/168

[58] Field of Search ..... 53/203, 390, 168; 414/911, 444, 490, 23; 242/533.8, 557, 597, 597.8; 280/47.24

[56] References Cited

U.S. PATENT DOCUMENTS

| | | | |
|---|---|---|---|
| 1,620,844 | 3/1927 | Walker | 242/557 X |
| 1,930,074 | 10/1933 | Bentley | 414/911 X |
| 2,310,036 | 2/1943 | Owens | 242/557 |
| 3,072,357 | 1/1963 | Sprague et al. | 242/557 |
| 3,995,758 | 12/1976 | Kovaleski | 414/911 X |
| 4,185,442 | 1/1980 | Johnson et al. | 53/168 |
| 4,369,614 | 1/1983 | Tetzner | 53/390 X |
| 4,557,716 | 12/1985 | Ottaviano | 242/557 X |
| 4,650,456 | 3/1987 | Armington | 493/464 |
| 4,824,313 | 4/1989 | Miller | 414/444 X |
| 4,856,960 | 8/1989 | Wheeler et al. | 414/911 X |
| 4,901,937 | 2/1990 | Mendoza | 242/557 |
| 5,000,394 | 3/1991 | Wales et al. | 242/557 X |
| 5,103,617 | 4/1992 | Sjogren et al. | 53/399 |
| 5,297,919 | 3/1994 | Reichental et al. | 414/911 |
| 5,382,131 | 1/1995 | Werthmann | 414/911 X |

*Primary Examiner*—James F. Coan
*Attorney, Agent, or Firm*—Louis Weinstein

[57] ABSTRACT

A carriage is provided for supporting a supply roll of wrap paper for use with a wrap apparatus. A spindle is cantilever mounted from one side of a frame to receive the supply roll thereon. A handle extends outwardly from the other side of the frame and may be selectively removed to allow operator access to a control panel of the wrap apparatus.

15 Claims, 3 Drawing Sheets

CARRIAGE FOR A WRAP APPARATUS

BACKGROUND OF THE INVENTION

This invention pertains to the art of paper supply apparatus and more particularly to a portable carriage that can easily transport paper supply rolls from one location to another and accurately position the supply roll in an associated apparatus. The invention is applicable to a portable carriage of a wrap apparatus as used in the mailroom industry and will be described with particular reference thereto. However, it will be appreciated that the invention has broader applications and may be advantageously employed in still other environments and applications.

A wrap apparatus as used in a mailroom receives bundles of signatures or papers, for example newspapers, as the bundles exit a stacker or other upstream device and proceed along a conveyor toward a distribution station. To protect the bundle, a sheet or wrap of paper is cut from the supply roll and positioned over selected surfaces of the bundle. For example, the apparatus can provide a bottom or three-quarter wrap arrangement, a primary distinction between such arrangements being the extent or length of wrap paper that is placed around the bundle.

A new supply roll for this wrap paper weighs on the order of 150 pounds and is typically mounted on the wrap apparatus beneath the conveyor line. The supply roll is supported on a fixed or rotatable spindle, where the spindle is oriented along a horizontal axis. The leading edge of the paper is fed through a series of fixed and movable rollers to a feed slot that opens upwardly through the conveyor line that traverses the bottom wrap apparatus. A suitable mechanism for feeding a predetermined length of wrap paper over .the bundle, cutting the paper to length, and properly orienting the paper over the bundle is provided. The particular details of the structure and operation of various wrap apparatus of this type are well known in the art and form no part of the subject invention. Accordingly, further discussion herein of those details are believed unnecessary.

In some wrap apparatus, the spindle is fixed to a lower portion or base of the apparatus. Thus, once the supply roll is depleted and a new roll is to be installed, an operator must transport the 150 pound supply roll from a remote storage location to the wrap apparatus. The supply roll is then lifted on to the spindle. As can be appreciated by those skilled in the art, the spindle is oftentimes located in a generally inaccessible area of the wrap apparatus, or it is simply difficult to manipulate the bulky and heavy supply roll in a confined area.

Other wrap apparatus of this type include a brake mechanism for controlling the feedout of the paper as it is used to wrap bundles. The requirement of a brake mechanism adds to the overall cost and operation of the wrap apparatus. Accordingly, a design that can eliminate a brake mechanism without adversely affecting the operation of the wrap apparatus would be helpful.

SUMMARY OF THE INVENTION

The present invention contemplates a new and improved carriage for a wrap apparatus that overcomes all of the above-referenced problems and others and provides for ease of setup, portability, assured location, and ease of use in replacing a supply roll.

According to the present invention, there is provided a carriage comprising a frame having a spindle extending outwardly from one side that receives a supply roll thereon.

A rolling member, such as a wheel, is also secured to the frame for purposes of portability.

According to another aspect of the invention, a handle extends from the frame and is adapted for selective removal.

According to yet another aspect of the invention, at least one guide member is provided on the frame for orienting the supply roll in the wrap apparatus.

According to a further aspect of the invention, a location member provides a positive feedback or indication to the operator that the carriage and supply roll are accurately positioned in the wrap apparatus.

According to yet another aspect of the invention, a clamp uses a non-circular opening for quickly and effectively holding the supply roll in place.

A principal advantage of the invention is the ease of portability in transporting a supply roll from a remote location to the wrap apparatus.

Another advantage of the invention resides in the ability to remove the handle to allow the operator to easily access the wrap apparatus with the carriage in place.

Still another advantage of the invention is found in the elimination of a brake mechanism.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
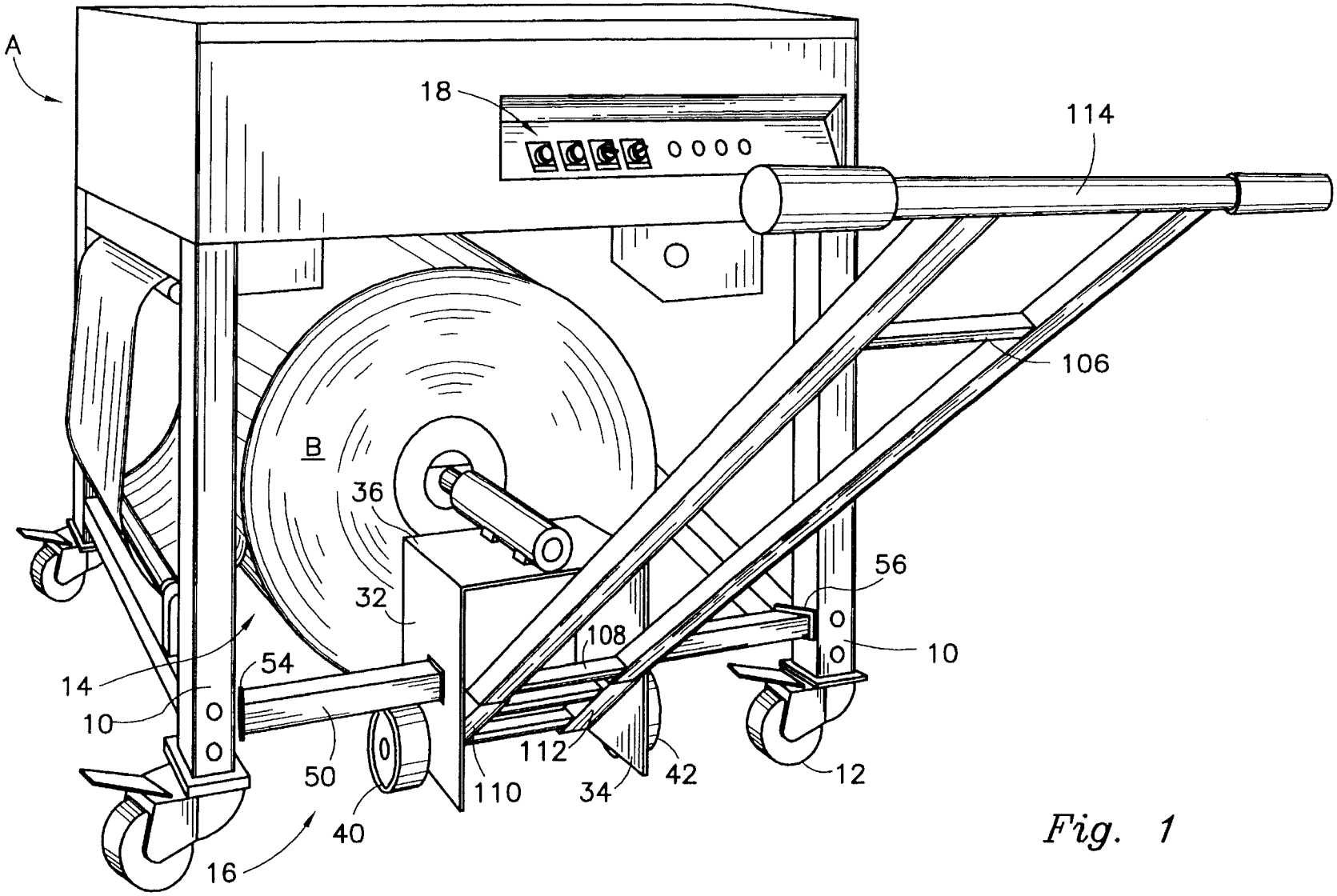
FIG. 1 is a perspective view of a carriage carrying a supply roll and installed within the base frame of a wrap apparatus.

Referring now to the drawings wherein the showings are for the purposes of illustrating the preferred embodiment of the invention only and not for purposes of limiting same, the FIGURES show a wrap apparatus A that includes a supply roll B of paper supported on a carriage C. More particularly, the wrap apparatus has a lower frame 10 that supports the apparatus and includes caster wheels or rollers 12 that allow the wrap apparatus to be selectively positioned in a desired location. Once positioned in a conveyor line, the wrap apparatus is locked in place, and the caster wheels may even be removed to prevent any movement of the wrap apparatus with respect to the remainder of the system.

The frame members defines an open cavity 14, which in the preferred embodiment is generally cubical in conformation. The cavity is open at a front or operator side 16 in which access to a control panel 18 used to control the operating parameters of the wrap apparatus is available. Unless specifically indicated below, the particular details of the structure and operation of the wrap apparatus form no part of the subject invention so that further discussion in that regard is unnecessary.

With continued reference to FIG. 1, and additional reference to FIGS. 2–4, the carriage C that transports and supports the supply roll B will be described in greater detail. The carriage includes a rigid frame 30 which in the preferred arrangement is defined by an inverted generally U-shaped frame member that includes downwardly extending legs 32, 34 interconnected by a generally horizontal portion 36. A pair of roller members or wheels 40, 42 are spaced apart along a common, fixed axis 44 that is generally orthogonal to the legs 32, 34 of the frame member. Preferably, an axle 44 extends through the spaced legs 32, 34 to support the first and second wheels outboard of the first and second legs 32, 34.

Vertically interposed between the horizontal member 36 and the axle 44 are a pair of frame extension members 50, 52 that are also generally orthogonal to legs 32, 34, respectively. In a preferred embodiment of the invention, the extension members are defined by square tubular members that are welded or otherwise fastened to the legs 32, 34. Outer terminal ends of the extension members each carry a guide member 54, 56. A preferred form of guide member is an angled plate secured to the extension member and angling inward through an acute angle toward the cavity of the wrap apparatus when the supply roll is positioned therein (FIG. 3). The guide member plates cooperate with the frame members 10, 10' to accurately locate the carriage in the open side 16 of the cavity. Minor misalignment is overcome by the abutting engagement between the angled guide plates and frame members 10, 10' the wrap apparatus frame 10.

Extending outwardly from one side of the frame 30 is a spindle 60. An inner end 62 of the spindle is secured to the frame, here shown as being welded to the horizontal member 36 of the frame. An outer or cantilevered end 64 extends generally perpendicularly from a plane defined the extension members 50, 52. The spindle has a length sufficient to extend beyond the width of the supply roll B. Also, the preferred spindle is fixed against rotation and is generally defined by a cylindrical member closely received within the core of the supply roll. This allows the supply roll to rotate on its core relative to the spindle and the friction therebetween exerts sufficient drag to eliminate the need for a separate brake mechanism for controlling feedout of wrap paper from the supply roll.

Figure 2:
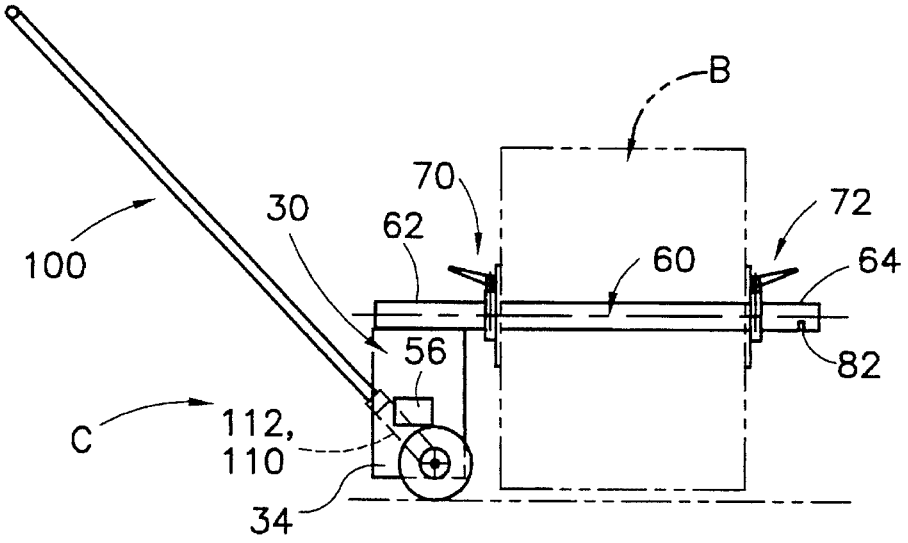
FIG. 2 is a side elevational view of the new carriage carrying a supply roll shown in phantom.
Figure 3:
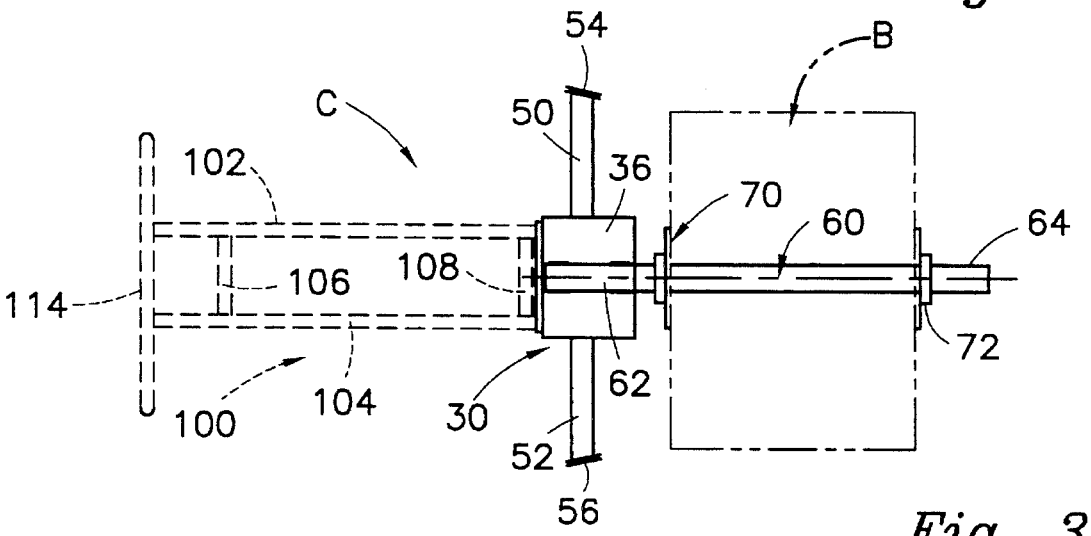
FIG. 3 is a top plan view of the carriage and supply roll shown in FIG. 2.
Figure 4:
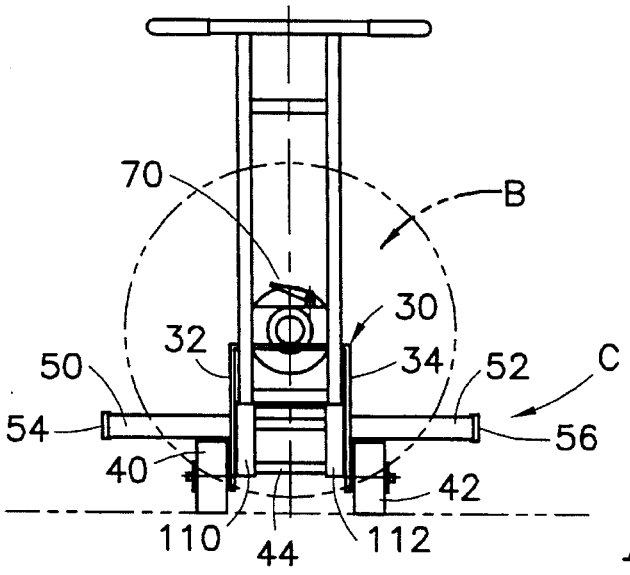
FIG. 4 is an elevational view taken generally from the left-hand side of FIG. 2.

A pair of clamps 70, 72 are received over the spindle and engage opposite ends of the supply roll (see FIGS. 2 and 3). The clamps limit relative sliding movement of the supply roll along the axis of the spindle while permitting rotation of the supply roll on the spindle. Particular details of the clamp mechanisms will be described below with respect to FIGS. 7 and 8.

Figure 5:
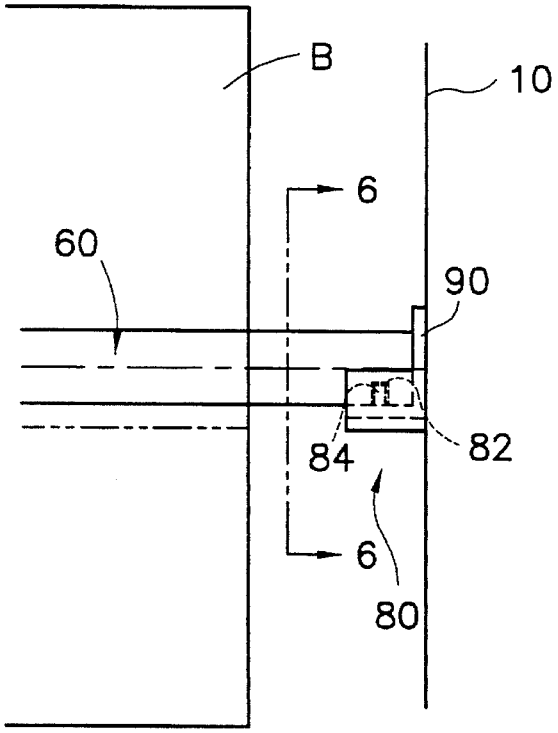
FIG. 5 is a substantially enlarged view the inner end of the spindle and its cooperation with a portion of the wrap apparatus.
Figure 6:
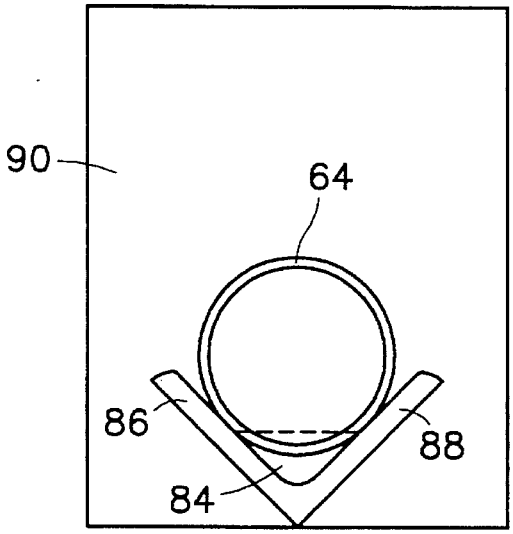
FIG. 6 is a view generally taken along the lines 6—6 of FIG. 5.

As additionally illustrated in FIGS. 5 and 6, the outer end 64 of the spindle includes a location member 80 defined by a cooperating pair of a notch 82 and flange 84. The notch and flange selectively interlock with one another to provide positive feedback to the operator of the accurate insertion, location, and support of the outer end 64 of the spindle on the flange 84 associated with the wrap apparatus frame 10. More particularly, the notch 82 is preferably located in a downwardly extending surface of the spindle and is axially spaced from the terminal end 64 of the spindle. The notch is dimensioned for cooperative receipt over a flange 84 interposed between legs 86, 88 of a V-shaped support member that are rigidly secured to and extend outwardly from an abutment plate 90 associated with the wrap apparatus frame. Once the terminal end of the spindle 64 engages the abutment plate 90, the notch 82 is accurately located over the upwardly extending flange 84 to cooperate therewith. The end of the spindle is then lowered so that the flange is received in the notch to prevent inadvertent axial pullout of the carriage from beneath the wrap apparatus. If the spindle, however, is rocked on its wheels 40, 42 so as to lift the end 64 of the spindle upwardly, the notch and flange disengage and the carriage can be moved axially outward from its operating position in the cavity 14 of the wrap apparatus.

Extending outwardly from the opposite side of the frame 30 is a removable handle 100. In the preferred arrangement, the handle includes a pair of elongated members 102, 104 disposed in spaced, parallel relation by cross members 106, 108. A push bar 114 is disposed at the outer ends of the elongate members 102, 104 while projecting ends of the elongate members are received in sockets 110, 112, respectively, welded to interior portions of legs 32, 34 of the carriage frame. This allows the inner ends of the elongate members to be telescopically received in the sockets until cross member 108 abuts against outer ends of the sockets. As shown, the sockets are angularly oriented relative to the frame so that the handle extends outwardly from one side of the frame at an angle between 30° and 75° to horizontal. When the supply roll B is mounted on the spindle, an operator can easily manipulate the carriage by using the handle 100. Downward force imposed on the push bar 114 of handle 100 pivots the carriage about the wheels to lift the supply roll B off the ground surface. The carriage carrying the supply roll can then be easily transported about the mailroom by counterbalancing the weight of the supply roll by exerting a downward force on the handle.

As shown in FIG. 3 by phantom lines, the handle 100 can be removed from the frame by lifting the handle out of the sockets 110, 112. This removable feature is particularly advantageous once the supply roll has been mounted within the cavity of the wrap apparatus. With the handle removed, an operator can easily access the control panel 18 without the handle interfering with such access.

Figure 7:
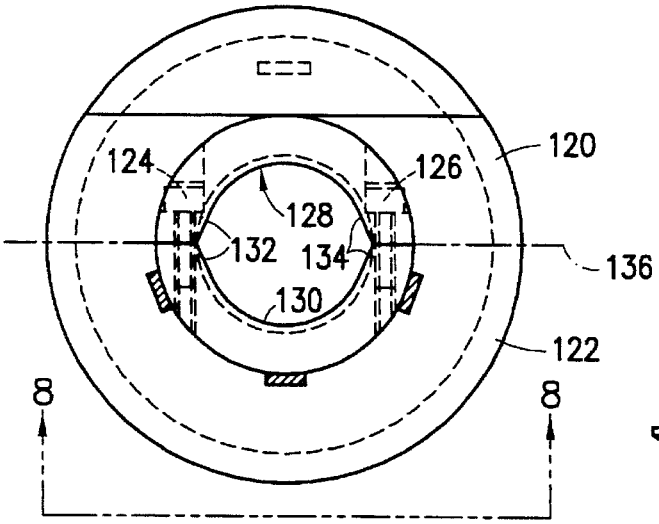
FIG. 7 is an elevational view of a preferred clamp mechanism for use in maintaining the supply roll on the spindle; and, FIG. 8 is a view look generally in the direction of arrows 8—8 of FIG. 7.
Figure 8:
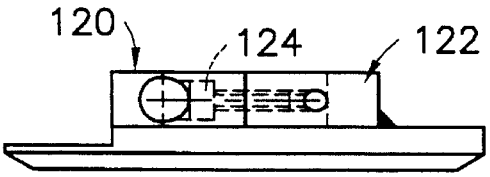

The clamps 70, 72 received at opposite ends of the supply roll are more particularly illustrated in FIGS. 7 and 8. Preferably, each clamp mechanism includes a pair of opposed halves 120, 122 secured together by fasteners 124, 126. The inner opening defined by the cooperating clamp halves preferably has a non-round or non-circular configuration 128. This is achieved by tapering opposite ends of a curvilinear or circular recess 130. This taper is designated by numerals 132, 134 adjacent the parting plane 136. It has been found that this clamp configuration provides a secure, easy to operate clamping mechanism that accurately holds the supply roll in place along the spindle. Additionally, this clamp configuration is easily removed from the spindle.

The cantilevered spindle extending outwardly from one side of the frame in cooperation with the handle angularly extending outwardly from the other side of the frame allows an operator to easily balance the heavy weight of the supply roll B on the wheels 40, 42. When a new supply roll is required, the clamp 72 is removed from the outer end of the spindle, the used supply roll core removed, and the carriage moved to the location of the new roll where the spindle is inserted into the new supply roll. The clamp mechanism is then positioned in place and the operator easily lifts the supply roll off the ground by exerting downward pressure on the handle 100. A supply roll is then easily transported to the cavity 14 where the supply roll is advanced into the cavity until the notch/flange interconnection is achieved. The guide plates 54, 56 facilitate accurate location of the carriage in the wrap apparatus. Once positive feedback is obtained that the carriage is accurately located, the handle can thereafter be removed to allow the operator access to the control panel.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A carriage for a wrap apparatus, the carriage comprising:

a frame;

a spindle extending outwardly from one side of the frame in generally cantilevered fashion and adapted to receive an associated paper supply roll thereon; and at least one rolling member secured to the frame adapted to facilitate movement of the carriage in and out of the associated wrap apparatus;

a handle extending from the frame to assist in transport of the carriage, said handle being removably connected to the frame for use when a supply roll is transported from a remote location to a location in the associated wrap apparatus.

2. The carriage as defined in claim 1 further comprising a removable clamp adapted for receipt over an outer end of the spindle, the clamp maintaining the supply roll in place on the spindle during transport and operation of the associated wrap apparatus.

3. A carriage for a wrap apparatus, the carriage comprising:

a frame;

a spindle extending outwardly from one side of the frame in generally cantilevered fashion and adapted to receive an associated paper supply roll thereon; and at least one rolling member secured to the frame adapted to facilitate movement of the carriage in and out of the associated wrap apparatus;

the carriage as defined in claim 1 further comprising a removable clamp adapted for receipt over an outer end of the spindle, the clamp maintaining the supply roll in place on the spindle during transport and operation of the associated wrap apparatus;

said clamp being defined by a pair of cooperating members each having a curvilinear recess therein, facing surfaces of the clamp members being relieved so that the recesses define a non-circular opening when the clamp members are brought into abutting engagement.

4. The carriage as defined in claim 1 wherein the handle extends generally outward from the frame in a direction opposite to the spindle.

5. The carriage as defined in claim 1 further comprising at least one guide member on the frame for orienting and positioning the carriage in the associated wrap apparatus.

6. A carriage for a wrap apparatus, the carriage comprising:

a frame;

a spindle extending outwardly from one side of the frame in generally cantilevered fashion and adapted to receive an associated paper supply roll thereon; and at least one rolling member secured to the frame adapted to facilitate movement of the carriage in and out of the associated wrap apparatus;

one of a notch and flange pair on the carriage cooperating with the other of the notch and flange pair on the associated wrap apparatus to provide positive feedback of proper receipt of the carriage in the associated wrap apparatus.

7. An apparatus for wrapping a bundle, the apparatus comprising:

a conveyor adapted to receive a bundle;

a roll of wrap paper received beneath the conveyor and adapted to dispense the wrap paper from beneath the conveyor through an opening in the conveyor and at least partially wrap about the bundle as it proceeds along the conveyor; and a moveable carriage for supporting the roll beneath the conveyor and facilitating transport of a new roll from a remote location, the carriage including a frame, a spindle extending outwardly from one side of the frame in generally cantilevered fashion and receiving the roll thereon, and at least one rolling member secured to the frame to facilitate movement of the carriage in and out from beneath the conveyor.

8. The apparatus as defined in claim 7 further comprising one of a notch and flange pair provided on the carriage and the other of the notch and flange pair provided on a frame supporting the conveyor, the notch and flange pair selectively cooperating with one another when the carriage is properly positioned beneath the conveyor.

9. The apparatus as defined in claim 8 wherein the one of the notch and flange pair is provided on the spindle.

10. The apparatus as defined in claim 7 wherein the carriage further comprises a handle removably secured to the frame.

11. The apparatus as defined in claim 10 wherein the handle extends outwardly from the frame in a direction generally opposite that of the spindle.

12. The apparatus as defined in claim 11 wherein the at least one rolling member includes first and second wheels secured to the frame.

13. The apparatus as defined in claim 7 wherein the carriage further comprises a guide member operatively associated with the frame for accurately positioning the carriage beneath the conveyor.

14. The apparatus as defined in claim 7 wherein the spindle includes a removable clamp member for retaining a roll of wrap paper thereon during transport of the carriage and operation of the bottom wrap apparatus.

15. The apparatus as defined in claim 14 wherein the clamp member includes first and second mating halves having a non-circular opening therethrough.

* * * * *